US012497740B1

(12) United States Patent
Swaringam et al.

(10) Patent No.: US 12,497,740 B1
(45) Date of Patent: Dec. 16, 2025

(54) SAFETY CAGE FOR A PAVING MACHINE

(71) Applicant: WEST CONTRACTING, Pacific, MO (US)

(72) Inventors: Tim Swaringam, Ironton, MO (US); Nick Brewer, Gerald, MO (US)

(73) Assignee: West Contracting, Pacific, MO (US)

( * ) Notice: Subject to any disclaimer, the term of this patent is extended or adjusted under 35 U.S.C. 154(b) by 0 days.

(21) Appl. No.: 19/232,707

(22) Filed: Jun. 9, 2025

Related U.S. Application Data

(60) Provisional application No. 63/752,329, filed on Jan. 31, 2025.

(51) Int. Cl.
*E01C 19/48* (2006.01)

(52) U.S. Cl.
CPC ..... *E01C 19/48* (2013.01); *E01C 2301/30* (2013.01)

(58) Field of Classification Search
CPC ..... E01C 19/48; E01C 2301/30
USPC ..... 404/83, 118
See application file for complete search history.

(56) References Cited

U.S. PATENT DOCUMENTS

| | | | | |
|---|---|---|---|---|
| 7,001,135 | B2 * | 2/2006 | Shimokakiuchi | E02F 9/163 296/102 |
| 8,591,146 | B2 * | 11/2013 | Begley | E01C 19/08 404/101 |
| 9,045,871 | B2 * | 6/2015 | Graham | E01C 19/4873 |
| 2022/0396920 | A1 * | 12/2022 | Makovsky | E01B 29/09 |

FOREIGN PATENT DOCUMENTS

| | | | | |
|---|---|---|---|---|
| DE | 29907291 | U1 * | 12/1999 | B60N 2/68 |
| EP | 1449966 | A2 * | 8/2004 | E02F 9/163 |
| RU | 116825 | U1 * | 6/2012 | |
| RU | 201177 | U1 * | 12/2020 | B66F 9/06 |
| RU | 204721 | U1 * | 6/2021 | B62D 33/06 |
| WO | WO-2005121460 | A1 * | 12/2005 | B60R 21/11 |
| WO | WO-2016014034 | A1 * | 1/2016 | E01C 19/238 |

* cited by examiner

*Primary Examiner* — Raymond W Addie
(74) *Attorney, Agent, or Firm* — Bryan Cave Leighton Paisner LLP

(57) ABSTRACT

The present disclosure provides, inter alia, paving machines comprising a safety cage for an operator and methods for paving a surface using the same.

27 Claims, 7 Drawing Sheets

SAFETY CAGE FOR A PAVING MACHINE

CROSS REFERENCE TO RELATED APPLICATIONS

The present application claims benefit of U.S. Provisional Patent Application Ser. No. 63/752,329, filed on Jan. 31, 2025, the entire content of which is hereby incorporated by reference.

FIELD OF DISCLOSURE

The present disclosure relates generally to the field of paving machines, and in particular, to its safe operation. More specifically, the present disclosure provides, inter alia, paving machines comprising a safety cage for an operator and methods for paving a surface using the same.

BACKGROUND OF THE DISCLOSURE

A paving machine (also called, e.g., paver or asphalt finisher, FIG. 1) is a piece of construction equipment used to deposit significant amounts of paving material such as, e.g., asphalt concrete or Portland cement concrete, on roads, bridges, parking lots and other such places. It lays the material flat and provides minor compaction. This is typically followed by final compaction by other machines such as a road roller.

Because paving material can be expensive and the quantities used can be large, applying pavement with a thickness that deviates from a desired thickness or smoothness can have costly consequences. Thus, during operation, from time to time, the operator needs to get out of the cab and check the paving status. Accordingly, the paving machines on the market are usually equipped with a pivoting seat for at least the operator, to ensure this person has a high visibility (FIG. 2A). Such a design, however, also possesses a potential risk to the operator when the seat is pivoted away from the main body of the paver, such as when there is an obstacle near the paving machine, for example, a tree, a trash car, a pedestrian, or a passing-by vehicle (FIG. 2B). While the commercially available paving machines often have some metal railing to help keep operators in the seat (FIG. 1), there is still insufficient protection for the head and neck, and upper body of the operator.

Accordingly, there is a need for a safety measure that can provide more desired protection to a person operating a paving machine or other machines equipped with similar pivoting seat. The present disclosure provides solutions to one or more of the problems set forth above.

SUMMARY OF THE DISCLOSURE

One aspect of the present disclosure relates to a paving machine comprising a safety cage for an operator. The paving machine comprises: a paving assembly, a drive assembly, and an operator control assembly. The paving assembly comprises: a hopper configured to hold paving material; a screed configured to distribute the paving material on a surface; and a paving material conveyor configured to transfer the paving material from the hopper to the screed for distribution of the paving material onto the surface. The drive assembly comprises at least one of wheels or a traction device, and a power source, for driving the paving machine along the surface for paving. The operator control assembly is mounted on a paving machine housing above the wheels or traction device of the drive assembly, the operator control assembly comprising: one or more controls for operation of the paving assembly and drive assembly; an operator seat mounted on a pivotable base that is attached at a pivot point to the pacing machine housing; and a safety cage about the operator seat, the safety cage being attached to one or more of the operator seat and pivotable base. The safety cage comprises: a frame extending behind the operator seat; one or more upper body protecting bars extending from the frame along the side of the operator seat, and towards a front of the operator seat, and one or more head and neck protecting bars extending from the frame at or above an upper end of the operator seat. The operator seat is pivotable in a horizontal direction during operation of the paving machine, to rotate the operator seat outwardly away from the paving machine housing, and the safety cage rotates with the operator seat to protect the head and neck, and the upper body, of the operator during operation of the paving machine.

Another aspect of the present disclosure relates to a method of paving a surface. This method comprises operating the paving machine disclosed herein to spread paving material on the surface.

BRIEF DESCRIPTION OF THE DRAWINGS

To facilitate further description of the embodiments of this disclosure, the following drawings are provided to illustrate and not to limit the scope of the disclosure.

DETAILED DESCRIPTION OF THE DISCLOSURE

Figure 1:
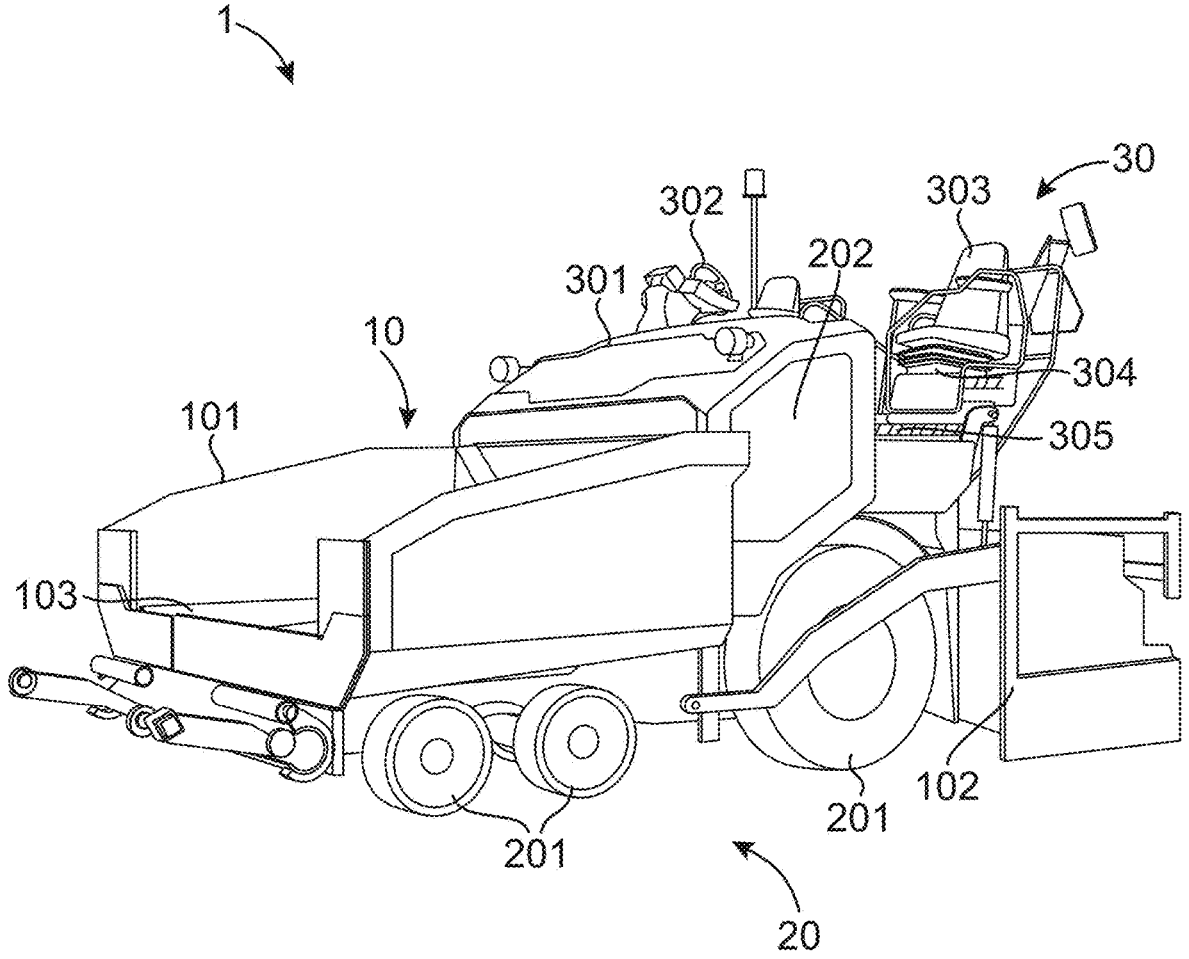
FIG. 1 (Prior Art)
FIG. 1 (PRIOR ART) illustrates a state of art paving machine.

Novel systems for safe operation of paving machines and the like and methods for paving a surface with higher safety are provided and described. Paving machines equipped with such systems or implementing such methods are also provided and described. Various embodiments and modifications are possible and fall within the scope of the present disclosure.

According to one aspect of the present disclosure, provided is a paving machine comprising a safety cage for an operator. The paving machine comprises: a paving assembly, a drive assembly, and an operator control assembly. The paving assembly comprises: a hopper configured to hold paving material; a screed configured to distribute the paving material on a surface; and a paving material conveyor configured to transfer the paving material from the hopper to the screed for distribution of the paving material onto the surface. The drive assembly comprises at least one of wheels or a traction device, and a power source, for driving the paving machine along the surface for paving. The operator control assembly is mounted on a paving machine housing above the wheels or traction device of the drive assembly, the operator control assembly comprising: one or more controls for operation of the paving assembly and drive assembly; an operator seat mounted on a pivotable base that is attached at a pivot point to the pacing machine housing; and a safety cage about the operator seat, the safety cage being attached to one or more of the operator seat and pivotable base. The safety cage comprises: a frame extending behind the operator seat; one or more upper body protecting bars extending from the frame along the side of the operator seat, and towards a front of the operator seat, and one or more head and neck protecting bars extending from the frame at or above an upper end of the operator seat. The operator seat is pivotable in a horizontal direction during operation of the paving machine, to rotate the operator seat outwardly away from the paving machine housing, and the safety cage rotates with the operator seat to protect the head and neck, and the upper body, of the operator during operation of the paving machine.

In some embodiments, the frame of the safety cage comprises two parallel bars that are directly or indirectly mounted to the pivotable base.

In some embodiments, the one or more upper body protecting bars of the safety cage comprises a pair of two parallel bars extending from the frame, each pair extending along opposing sides of the operator seat. To ensure the free movement of the operator on the seat, in some embodiments, the two parallel bars of each pair extend along their respective opposing sides at an angle of from 0° to 90°, 15° to 75°, 30° to 50°, and/or at 45°, with respect to respective opposing sides of the operator seat.

To provide protection to both the lower body and upper body of the operator, in some embodiments, the two parallel bars of each pair are spaced apart from each other in the vertical direction, with a lower bar being located towards a lower end of the operator seat, and an upper bar being located towards an upper end of the operator seat. In some embodiments, the two parallel bars of each pair are vertically spaced apart from each other by at least 10 inches, at least 12 inches, at least 15 inches, at least 18 inches, and/or at least 20 inches, and no more than 30 inches, no more than 25 inches, and/or no more than 22 inches.

In some embodiments, the two parallel bars of each pair extend from the frame along the respective opposing sides of the operator seat by a length of at least 4 inches, at least 6 inches, and/or at least 7 inches, and no more than 15 inches, no more than 12 inches and/or no more than 10 inches.

In some embodiments, for the two parallel bars of each pair, a ratio of the vertical distance between the two parallel bars, to a length the bars extend along respective opposing sides of the operator seat, is at least 1.5:1, at least 1.75:1, at least 2:1, at least 2.25:1 and/or at least 2.5:1, and less than 5:1, less than 4:1, less than 3:1 and/or less than 2.75:1.

In some embodiments, the two parallel bars of each pair are connected together by a connecting bar that is spaced away from the frame. In some embodiments, the connecting bar has a length connecting the two parallel bars of each respective pair together of at least 10 inches, at least 12 inches, at least 15 inches, at least 18 inches, and/or at least 20 inches, and no more than 30 inches, no more than 25 inches, and/or no more than 22 inches. The connecting bar can be any suitable shape, for example, in some embodiments, the connecting bar is a U-shaped bar.

In some embodiments, the frame of the safety cage comprises two parallel bars that extend vertically towards a top of the operator seat. In some embodiments, for each pair of the two parallel bars extending along respective sides of the operator seat, the connecting bar connecting the two parallel bars, and at least a portion of the two parallel bars of the frame, together with the two parallel bars of each pair, form an impact blocking structure that protects the upper body of operator from impacts to the upper body during operation of the paving machine.

To ensure sufficient protection to the back of the operator, the frame of the safety cage should be wide enough in the horizontal direction. Accordingly, in some embodiments, a distance between the two parallel bars of the frame in the horizontal direction is at least 16 inches, at least 18 inches, at least 20 inches, and/or at least 22 inches, and no more than 30 inches, no more than 28 inches, and//or no more than 26 inches.

In some embodiments, the one or more head and neck protecting bars of the safety cage comprises a lower bar and an upper bar extending between the two parallel bars of the frame, and wherein the lower and upper bar are both located toward or above a top of the operator seat. In some embodiments, the lower bar is located towards an upper end of the operator seat, but below a top of the operator seat, and the upper bar is located above the top of the operator seat. To avoid impact of an object that may pass through in between the two vertically oriented parallel bars of the frame, in some embodiments, the upper bar is curved to connect to the two parallel bars of the frame.

In some embodiments, a height of the upper bar, as measured from an opposing end of the frame, is at least 26 inches, at least 28 inches, and/or at least 30 inches, and no more than 40 inches, 38 inches, 36 inches and/or 35 inches. In some embodiments, a height of the lower bar, as measured from an opposing end of the frame, is at least 20 inches, at least 22 inches and/or at least 24 inches, and less than 30 inches, less than 28 inches, and/or less than 26 inches. In some embodiments, a vertical distance between the upper and lower bars is at least 6 inches, at least 8 inches and/or at least 10 inches, and less than 18 inches, less than 16 inches and/or less than 14 inches.

In some embodiments, length of each of the upper and lower bars in the horizontal direction extending between the parallel bars of the frame is at least 16 inches, at least 18 inches, at least 20 inches, and/or at least 22 inches, and no more than 30 inches, no more than 28 inches, and//or no more than 26 inches.

The upper and lower bars extending between the parallel bars of the frame do not necessarily have the same length. It may vary as desired. For example, in some embodiments, a ratio of a length in the horizontal direction of the upper and lower bars, to the vertical distance between the upper and lower bars, is at least 1.5:1, at least 1.75:1, at least 2:1, at least 2.25:1 at least 2.5:1, and/or at least 2.75:1, and less than 5:1, less than 4:1, less than 3:1 and/or less than 2.9:1.

In some embodiments, the upper and lower bars, and portions of the parallel bars of the frame that connect the upper and lower bars, form an impact blocking structure that protects the head and neck of the operator from impacts to the head and neck during operation of the paving machine.

A paving machine can have more than one operator or accommodate a non-operating passenger. Accordingly, in some embodiments, the paving machine comprises at least two of the operation control assemblies, with each of the operation control assemblies comprises respective safety cages.

In some embodiments, the safety cage is absent of any overhead enclosure.

In some embodiments, the safety cage is attached by welding or bolting onto the operator seat or pivotable base.

Another aspect of the present disclosure is directed to a method of paving a surface. This method comprises operating the paving machine disclosed herein to spread paving material on the surface.

The following discussion provides examples to further illustrate the present disclosure. These examples are illustrative only and are not intended to limit the scope of the disclosure in any way.

Figure 2A:
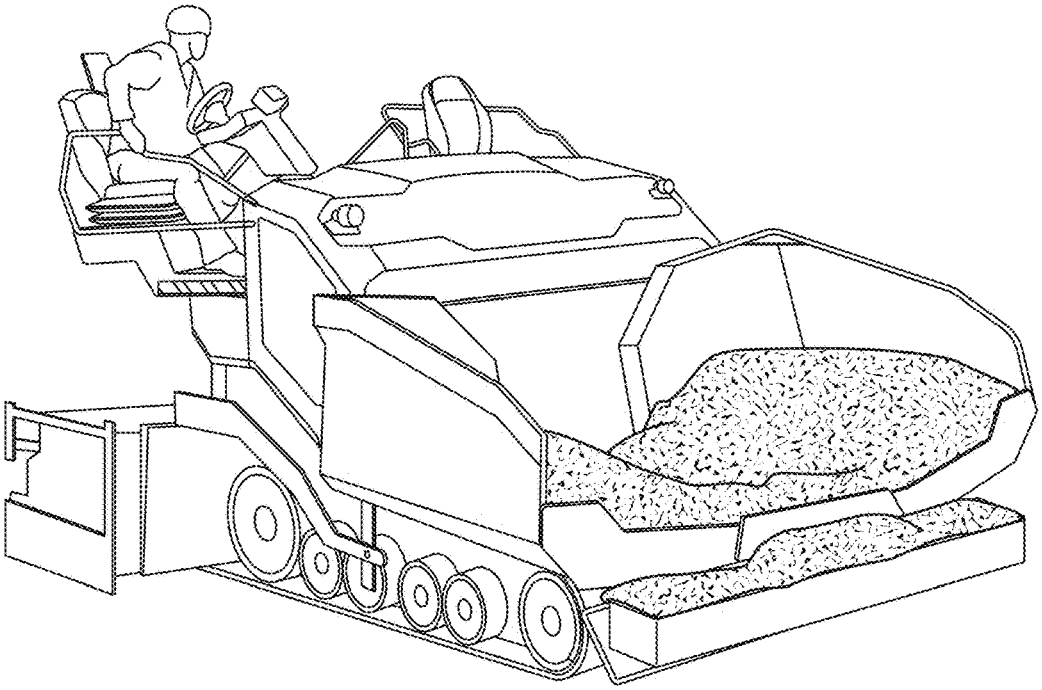
FIG. 2A (Prior Art)
FIG. 2A (PRIOR ART) illustrates that during operation, the operator seat is pivoting outside the cab.
Figure 2B:
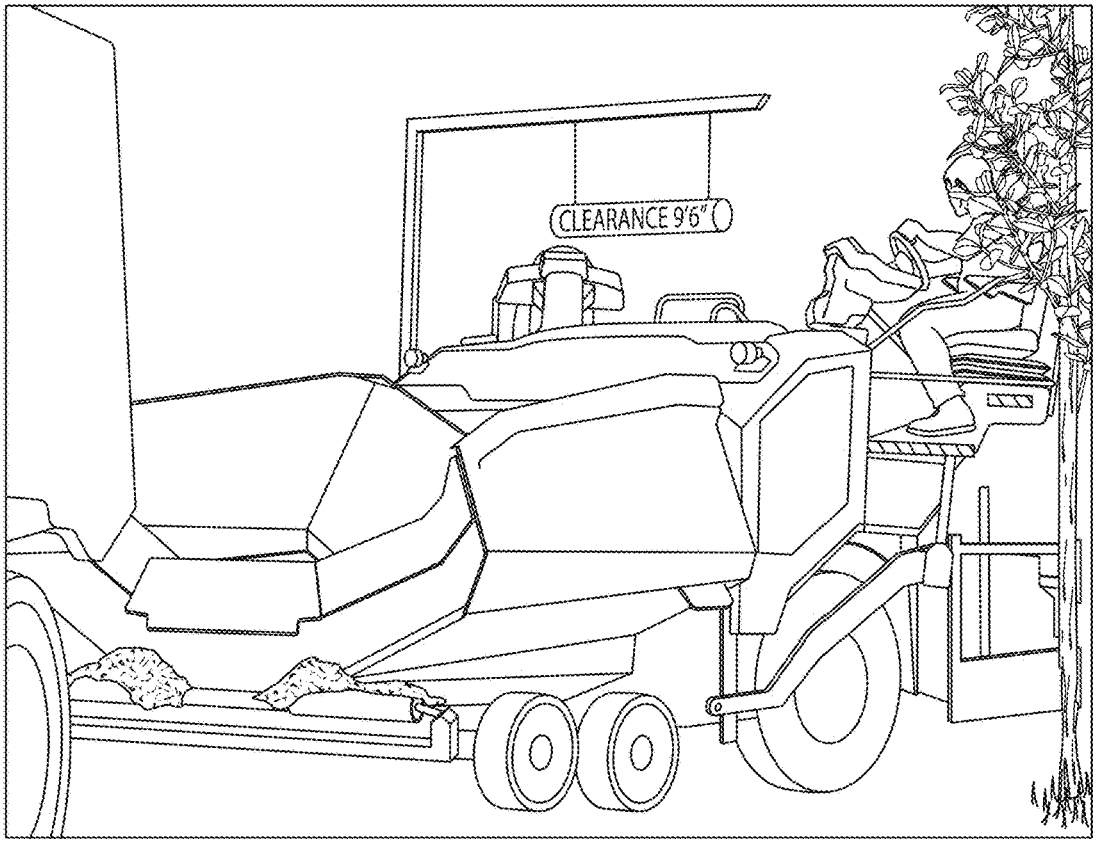
FIG. 2B (Prior Art)
FIG. 2B (PRIOR ART) illustrates potential risk to the operator from objects nearby during operation.
Figure 2C:
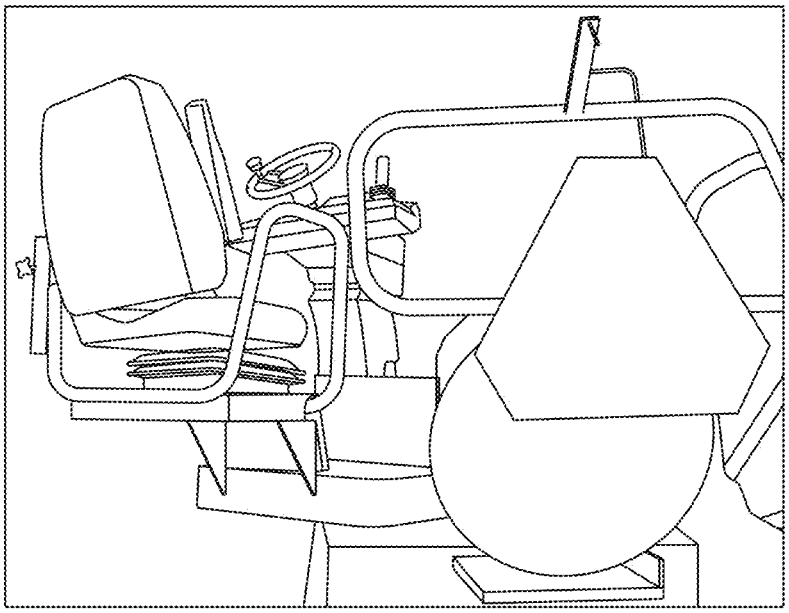
FIG. 2C (Prior Art)
FIGS. 2C-2D (PRIOR ART) provide additional views of a conventional paving machine with the seat pivoted out (2C), and pivoted back in (2D), from the back.
Figure 2D:
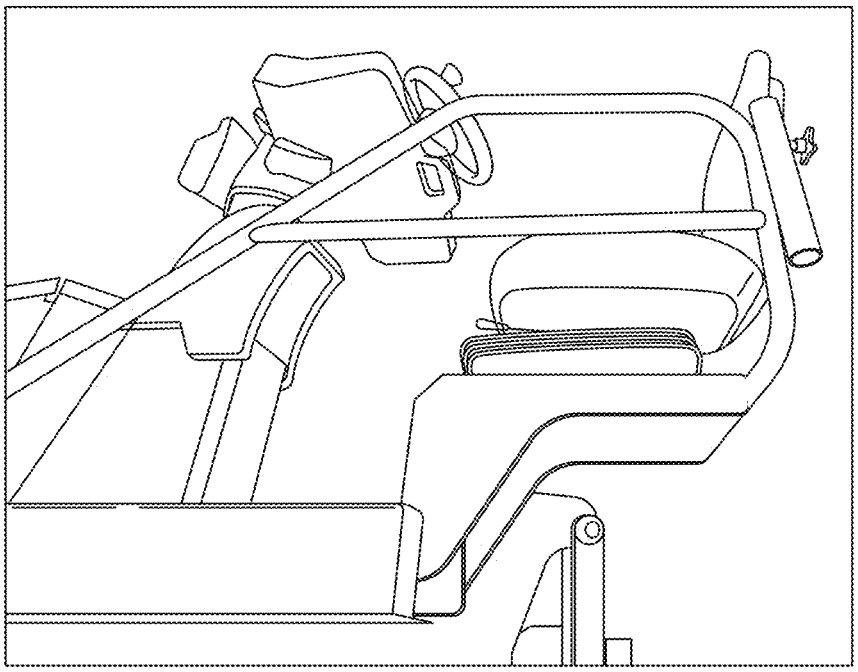
FIG. 2D (Prior Art)

Referring to FIG. 1, a typical paving machine 1 comprises: a paving assembly 10, a drive assembly 20, and an operator control assembly 30. The paving assembly 10 usually comprises: a hopper 101 configured to hold paving material; a screed 102 configured to distribute the paving material on a surface; and a paving material conveyor 103 configured to transfer the paving material from the hopper 101 to the screed 102 for distribution of the paving material onto the surface. The paving material conveyor can comprise a conveyor belt system, slat conveyors, or auger conveyors, among other devices for delivering materials to the screed. The drive assembly 20 comprises at least one of wheels or a traction device 201, and a power source 202, which can be in any applicable format, including but not limited to, a combustion engine or a battery, for driving the paving machine 100 along the surface for paving. The operator control assembly 30 is mounted on a paving machine housing 301 above the wheels or traction device 201 of the drive assembly 20, the operator control assembly 30 comprising: one or more controls 302 for operation of the paving assembly 10 and drive assembly 20; an operator seat 303 mounted on a pivotable base 304 that is attached at a pivot point 305 to the pacing machine housing 301. During operation, the operator seat 303 along with the pivotable base 304 it mounted on can rotate outwardly away from the paving machine housing 301, as shown in FIG. 2A, to provide the operator a better visibility. Because the currently available paving machine is only equipped with protecting bars or plates at a low height (FIGS. 1 and 2A), the outward rotation/movement of the operator seat 303 and pivotable base 304 may cause danger/injury to the head and neck and upper body of the operator, such as being hit by the tree as shown in FIG. 2B.

Figure 3:
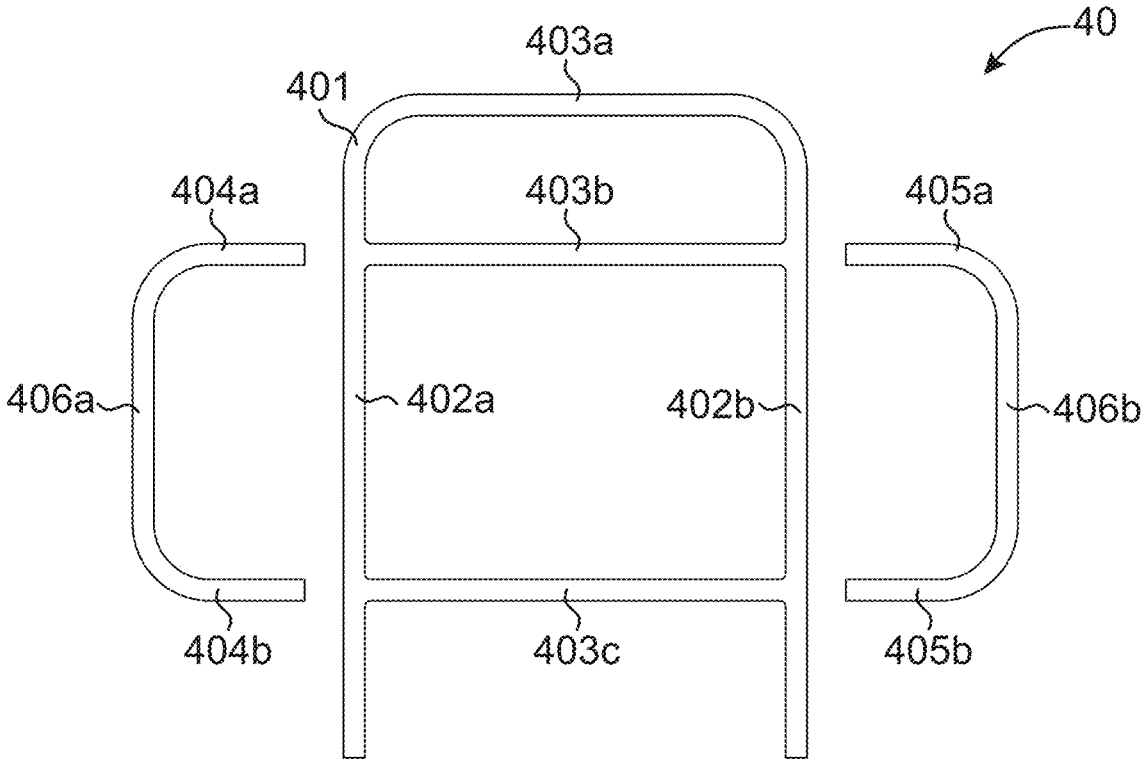
FIG. 3 is disassembled view of a safety cage in accordance with certain embodiments of the present disclosure.
Figure 4A:
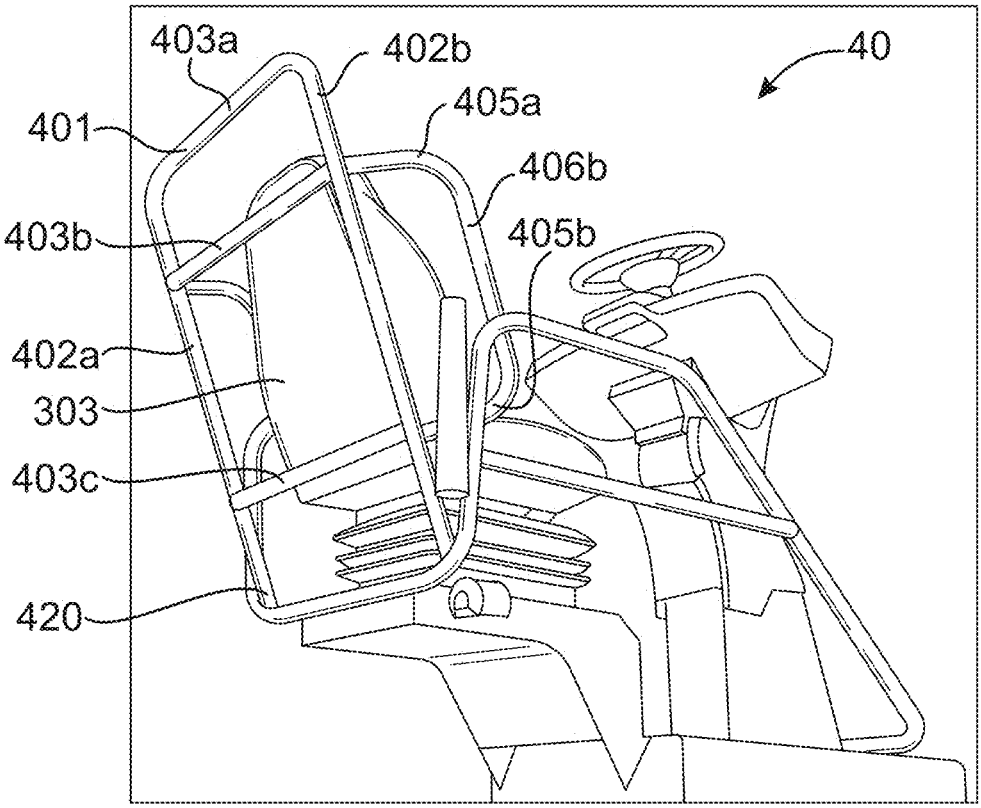
FIG. 4A is a rear perspective view of the safety cage described according to aspects of the present disclosure from right side.
Figure 4B:
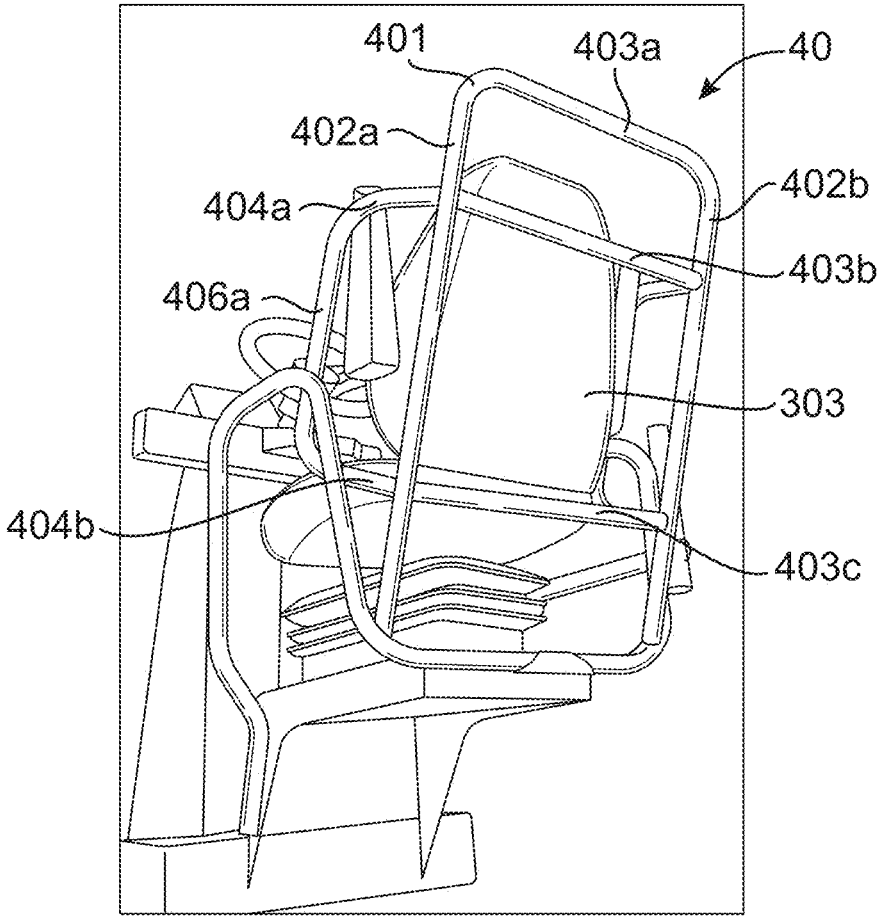
FIG. 4B is a rear perspective view of the safety cage in FIG. 4A from left side.
Figure 4C:
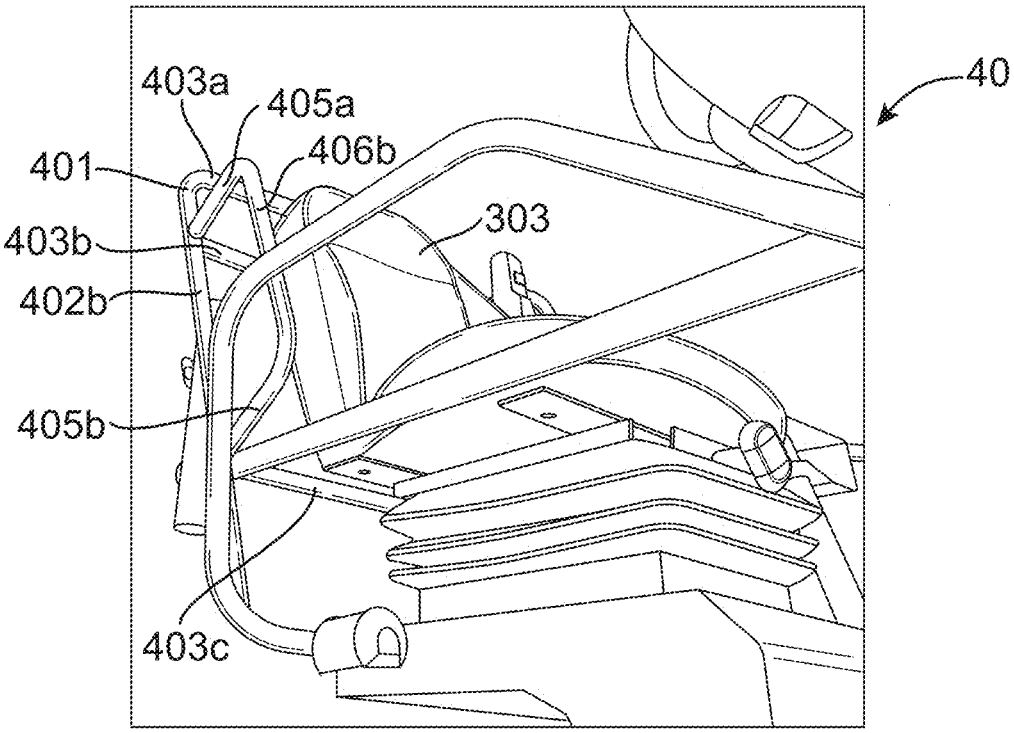
FIG. 4C is a front perspective view of the safety cage in FIG. 4A from right side.

Embodiments of the paving machine disclosed herein address this issue. According to aspects of the present disclosure, a safety cage 40 is added to the operator control assembly 30, as shown in FIGS. 4A-4C. Referring to FIG. 3, a dissembled safety cage 40 is shown in parts. The safety cage comprises: a frame 401 consisting of two parallel bars 402*a*, 402*b*, connected by an upper bar 403*a*, a lower bar 403*b*, and a supporting bar 403*c*, and two pairs of parallel bars 404*a* and 404*b*, and 405*a* and 405*b*, connected together by a connecting bar 406*a*, 406*b*, respectively.

Referring to FIGS. 4A-4C, when assembled and installed to the paving machine 1, in one embodiment of the present disclosure, the safety cage 40 is located about the operator seat 303. In some embodiments, the safety cage 40 is attached to one or more of the operator seat 303 and pivotable base 304 by standard processes used in the industry, including but not limited to, welding or bolting. During operation of the paving machine 1, the operator seat 303 is pivotable in a horizontal direction, to rotate the operator seat 303 outwardly away from the paving machine housing 301, and the safety cage 40 rotates with the operator seat 303 to protect the head and neck, and the upper body, of the operator during operation of the paving machine 1.

As shown in FIGS. 4A-4C, in one embodiment of the present disclosure, the frame 401 (with the parallel bars 402*a*, 402*b*) extends behind the operator seat 303, vertically towards a top of the operator seat 303. The two pairs of parallel bars 404*a* and 404*b*, and 405*a* and 405*b*, together with their respective connecting bars 406*a*, 406*b*, function as the upper body protecting bars extending from the frame 401 along the side of the operator seat 303, and towards a front of the operator seat 303. For each pair of the two parallel bars (404*a* and 404*b*, and 405*a* and 405*b*) extending along respective sides of the operator seat, the connecting bar 406*a*, 406*b* connecting the two parallel bars, and at least a portion of the two parallel bars 402*a*, 402*b* of the frame 401, together with the two parallel bars of each pair, form an impact blocking structure that protects the upper body of operator from impacts to the upper body during operation of the paving machine 1.

The upper bar 403*a* and lower bar 403*b* function as one or more head and neck protecting bars extending between the two parallel bars 402*a*, 402*b* of the frame 401 at or above an upper end (top) of the operator seat 303. In a certain embodiment, the lower bar 403*b* can be located towards an upper end of the operator seat 303, but below a top of the operator seat, and the upper bar 403*a* is located above the top of the operator seat 303. The supporting bar 403*c* connects the parallel bars 402*a*, 402*b* of the frame 401 at approximately the sitting level of the operator seat 303 to reinforce the frame 401. To ensure sufficient protection to the back of the operator, the frame 401 of the safety cage 40 should be wide enough in the horizontal direction. Thus, in one embodiment of the present disclosure, a distance between the two parallel bars of the frame in the horizontal direction is at least 16 inches, at least 18 inches, at least 20 inches, and/or at least 22 inches, and no more than 30 inches, no more than 28 inches, and//or no more than 26 inches. Additionally, to avoid impact of an object that may pass through inbetween the two vertically oriented parallel bars 402*a*, 402*b* of the frame 401, such as that is shown in FIG. 2B, in one embodiment, the upper bar 403*a* is curved to connect to the two parallel bars of the frame.

To ensure the free movement of the operator on the seat, the two parallel bars of each pair (404*a* and 404*b*, and 405*a* and 405*b*) extend along their respective opposing sides at an angle with respect to respective opposing sides of the operator seat 303. Such angle can be in the range of from 0° to 90°, 15° to 75°, 30° to 50°, and/or at 45°. According to another embodiment, the two parallel bars of each pair are parallel with the respect to the respective opposing sides of the operator seat 303. Referring back to FIGS. 3 and 4A-4C, the two parallel bars of each pair (404*a* and 404*b*, and 405*a* and 405*b*) are spaced apart from each other in the vertical direction, with the lower bars 404*b*, 405*b* being located towards a lower end of the operator seat 303, and the upper bars 404*a*, 405*a* being located towards an upper end of the operator seat 303. The two parallel bars of each pair (404*a* and 404*b*, and 405*a* and 405*b*) are vertically spaced apart from each other by any suitable distance. For example, such distance can be at least 10 inches, at least 12 inches, at least 15 inches, at least 18 inches, and/or at least 20 inches, and no more than 30 inches, no more than 25 inches, and/or no more than 22 inches.

For any given type and size of paving machine to which the safety cage is installed, the two parallel bars of each pair (404*a* and 404*b*, and 405*a* and 405*b*) extend from the frame 401 along the respective opposing sides of the operator seat 303 by a length of at least 4 inches, at least 6 inches, and/or at least 7 inches, and no more than 15 inches, no more than 12 inches and/or no more than 10 inches. In some embodiments, for the two parallel bars of each pair, a ratio of the vertical distance between the two parallel bars, to a length the bars extend along respective opposing sides of the operator seat, is at least 1.5:1, at least 1.75:1, at least 2:1, at least 2.25:1 and/or at least 2.5:1, and less than 5:1, less than 4:1, less than 3:1 and/or less than 2.75:1.

As shown in FIGS. 4A-4C, the connecting bars 406*a*, 406*b* respectively connecting the two parallel bars of each pair (404*a* and 404*b*, and 405*a* and 405*b*) are spaced away from the frame 401. Lengthwise, the connecting bars 406*a*, 406*b* can have a length connecting the two parallel bars of each respective pair together of at least 10 inches, at least 12 inches, at least 15 inches, at least 18 inches, and/or at least 20 inches, and no more than 30 inches, no more than 25 inches, and/or no more than 22 inches. The connecting bars can be any suitable shape, for example, in some embodiments, the connecting bar is a U-shaped bar. The upper and lower bars 403*a*, 403*b*, and portions of the parallel bars 402*a*, 402*b* of the frame 401 that connect the upper and lower bars, form an impact blocking structure that protects the head and neck of the operator from impacts to the head and neck during operation of the paving machine 1.

As to the vertical dimension, a height of the upper bar 403*a*, as measured from an opposing end 420 of the frame 401, is at least 26 inches, at least 28 inches, and/or at least 30 inches, and no more than 40 inches, 38 inches, 36 inches and/or 35 inches. A height of the lower bar 403*b*, as measured from an opposing end 420 of the frame, is at least 20 inches, at least 22 inches and/or at least 24 inches, and less than 30 inches, less than 28 inches, and/or less than 26 inches. And a vertical distance between the upper and lower bars 403*a*, 403*b* is at least 6 inches, at least 8 inches and/or at least 10 inches, and less than 18 inches, less than 16 inches and/or less than 14 inches.

As to the horizontal dimension, the length of each of the upper and lower bars 403*a*, 403*b* in the horizontal direction extending between the parallel bars 402*a*, 402*b* of the frame 401 is at least 16 inches, at least 18 inches, at least 20 inches, and/or at least 22 inches, and no more than 30 inches, no more than 28 inches, and//or no more than 26 inches. The upper and lower bars extending between the parallel bars of the frame do not necessarily have the same length. It may vary as desired. For example, in some embodiments, a ratio of a length in the horizontal direction of the upper and lower bars, to the vertical distance between the upper and lower bars, is at least 1.5:1, at least 1.75:1, at least 2:1, at least 2.25:1 at least 2.5:1, and/or at least 2.75:1, and less than 5:1, less than 4:1, less than 3:1 and/or less than 2.9:1.

The safety cage 40, including the frame 401 (with the parallel bars 402*a*, 402*b*), the upper bar 403*a*, the lower bar 403*b*, the supporting bar 403*c*, two pairs of parallel bars 404*a* and 404*b*, and 405*a* and 405*b*, and the connecting bars 406*a*, 406*b*, can be constructed with any suitable materials that can provide sufficient structural strength. Such materials may include but not limited to metals, alloys, engineering plastics, fiber glass, etc. The materials may also be able to provide thermal insulation to some extent.

Considering the high temperature working environment of a paving project, the areas between the above-mentioned bars may be empty to provide good ventilation. Alternatively, some mesh-like structure may be employed to both allow air flow and provide extra protection to the operator. In certain embodiments, transparent panels may be provided to ensure good visibility.

The following embodiments are provided to illustrate aspects of the disclosure, although the embodiments are not intended to be limiting and other aspects and/or embodiments may also be provided.

Embodiment 1. A paving machine comprising a safety cage for an operator, the paving machine comprising:

- a paving assembly comprising:
  - a hopper configured to hold paving material;
  - a screed configured to distribute the paving material on a surface; and
  - a paving material conveyor configured to transfer the paving material from the hopper to the screed for distribution of the paving material onto the surface;
- a drive assembly comprising at least one of wheels or a traction device, and a power source, for driving the paving machine along the surface for paving;
- an operator control assembly mounted on a paving machine housing above the wheels or traction device of the drive assembly, the operator control assembly comprising:
  - one or more controls for operation of the paving assembly and drive assembly;
  - an operator seat mounted on a pivotable base that is attached at a pivot point to the paving machine housing; and
  - a safety cage about the operator seat, the safety cage being attached to one or more of the operator seat and pivotable base, wherein the safety cage comprises:

- (i) a frame extending behind the operator seat;
- (ii) one or more upper body protecting bars extending from the frame along the side of the operator seat, and towards a front of the operator seat, and
- (iii) one or more head and neck protecting bars extending from the frame at or above an upper end of the operator seat, wherein the operator seat is pivotable in a horizontal direction during operation of the paving machine, to rotate the operator seat outwardly away from the paving machine housing, and wherein the safety cage rotates with the operator seat to protect the head and neck, and the upper body, of the operator during operation of the paving machine.

Embodiment 2. The paving machine according to Embodiment 1, wherein the frame comprises two parallel bars that are directly or indirectly mounted to the pivotable base.

Embodiment 3. The paving machine according to any preceding Embodiment, wherein the one or more upper body protecting bars comprises a pair of two parallel bars extending from the frame, each pair extending along opposing sides of the operator seat.

Embodiment 4. The paving machine according to any preceding Embodiment, wherein the two parallel bars of each pair extend along their respective opposing sides at an angle of from 0° to 90°, 15° to 75°, 30° to 50°, and/or at 45°, with respect to respective opposing sides of the operator seat.

Embodiment 5. The paving machine according any preceding Embodiment, wherein the two parallel bars of each pair are spaced apart from each other in the vertical direction, with a lower bar being located towards a lower end of the operator seat, and an upper bar being located towards an upper end of the operator seat.

Embodiment 6. The paving machine according to any preceding Embodiment, wherein the two parallel bars of each pair are vertically spaced apart from each other by at least 10 inches, at least 12 inches, at least 15 inches, at least 18 inches, and/or at least 20 inches, and no more than 30 inches, no more than 25 inches, and/or no more than 22 inches.

Embodiment 7. The paving machine according to any preceding Embodiment, wherein the two parallel bars of each pair extend from the frame along the respective opposing sides of the operator seat by a length of at least 4 inches, at least 6 inches, and/or at least 7 inches, and no more than 15 inches, no more than 12 inches and/or no more than 10 inches.

Embodiment 8. The paving machine according to any preceding Embodiment, wherein for the two parallel bars of each pair, a ratio of the vertical distance between the two parallel bars, to a length the bars extend along respective opposing sides of the operator seat, is at least 1.5:1, at least 1.75:1, at least 2:1, at least 2.25:1 and/or at least 2.5:1, and less than 5:1, less than 4:1, less than 3:1 and/or less than 2.75:1.

Embodiment 9. The paving machine according to any preceding Embodiment, wherein the two parallel bars of each pair are connected together by a connecting bar that is spaced away from the frame.

Embodiment 10. The paving machine according to any preceding Embodiment, wherein the connecting bar has a length connecting the two parallel bars of each respective pair together of at least 10 inches, at least 12 inches, at least 15 inches, at least 18 inches, and/or at least 20 inches, and no more than 30 inches, no more than 25 inches, and/or no more than 22 inches.

Embodiment 11. The paving machine according to any preceding Embodiment, wherein the connecting bar is a U-shaped bar.

Embodiment 12. The paving machine according to any preceding Embodiment, wherein the frame comprises two parallel bars that extend vertically towards a top of the operator seat.

Embodiment 13. The paving machine according to any preceding Embodiment, wherein for each pair of the two parallel bars extending along respective sides of the operator seat, the connecting bar connecting the two parallel bars, and at least a portion of the two parallel bars of the frame, together with the two parallel bars of each pair, form an impact blocking structure that protects the upper body of operator from impacts to the upper body during operation of the paving machine.

Embodiment 14. The paving machine according to any preceding Embodiment, wherein a distance between the two parallel bars of the frame in the horizontal direction is at least 16 inches, at least 18 inches, at least 20 inches, and/or at least 22 inches, and no more than 30 inches, no more than 28 inches, and//or no more than 26 inches.

Embodiment 15. The paving machine according to any preceding Embodiment, wherein the one or more head and neck protecting bars comprises a lower bar and an upper bar extending between the two parallel bars of the frame, and wherein the lower and upper bar are both located toward or above a top of the operator seat.

Embodiment 16. The paving machine according to any preceding Embodiment, wherein the lower bar is located towards an upper end of the operator seat, but below a top of the operator seat, and the upper bar is located above the top of the operator seat.

Embodiment 17. The paving machine according to any preceding Embodiment, wherein the upper bar is curved to connect to the two parallel bars of the frame.

Embodiment 18. The paving machine according to any preceding Embodiment, wherein a height of the upper bar, as measured from an opposing end of the frame, is at least 26 inches, at least 28 inches, and/or at least 30 inches, and no more than 40 inches, 38 inches, 36 inches and/or 35 inches.

Embodiment 19. The paving machine according to any preceding Embodiment, wherein a height of the lower bar, as measured from an opposing end of the frame, is at least 20 inches, at least 22 inches and/or at least 24 inches, and less than 30 inches, less than 28 inches, and/or less than 26 inches.

Embodiment 20. The paving machine according to any preceding Embodiment, wherein a vertical distance between the upper and lower bars is at least 6 inches, at least 8 inches and/or at least 10 inches, and less than 18 inches, less than 16 inches and/or less than 14 inches.

Embodiment 21. The paving machine according to any preceding Embodiment, wherein length of each of the upper and lower bars in the horizontal direction extending between the parallel bars of the frame is at least 16 inches, at least 18 inches, at least 20 inches, and/or at least 22 inches, and no more than 30 inches, no more than 28 inches, and//or no more than 26 inches.

Embodiment 22. The paving machine according to any preceding Embodiment, wherein a ratio of a length in the horizontal direction of the upper and lower bars, to the vertical distance between the upper and lower bars, is at least 1.5:1, at least 1.75:1, at least 2:1, at least 2.25:1 at least 2.5:1, and/or at least 2.75:1, and less than 5:1, less than 4:1, less than 3:1 and/or less than 2.9:1.

Embodiment 23. The paving machine according to any preceding Embodiment, wherein the upper and lower bars, and portions of the parallel bars of the frame that connect the upper and lower bars, form an impact blocking structure that protects the head and neck of the operator from impacts to the head and neck during operation of the paving machine.

Embodiment 24. The paving machine according to any preceding Embodiment, wherein the paving machine comprises at least two of the operation control assemblies, with each of the operation control assemblies comprises respective safety cages.

Embodiment 25. The paving machine according to any preceding Embodiment, wherein the safety cage is absent of any overhead enclosure.

Embodiment 26. The paving machine according to any preceding Embodiment, wherein the safety cage is attached by welding or bolting onto the operator seat or pivotable base.

Embodiment 27. A method of paving a surface, comprising operating the paving machine according to any preceding Embodiment to spread paving material on the surface.

Although illustrative embodiments of the present disclosure have been described herein, it should be understood that the disclosure is not limited to those described, and that various other changes or modifications may be made by one skilled in the art. For example, it should be understood that various omissions and substitutions and changes in the form and details of the systems and methods described and illustrated may be made by those skilled in the art. Amongst other things, the steps in the methods may be carried out in different orders in many cases where such may be appropriate. Further variations, modifications, and implementations may occur to those of ordinary skill in the art without departing from the scope or spirit of the disclosure.

What is claimed is:

1. A paving machine comprising a safety cage for an operator, the paving machine comprising:

a paving assembly comprising:

a hopper configured to hold paving material;

a screed configured to distribute the paving material on a surface; and a paving material conveyor configured to transfer the paving material from the hopper to the screed for distribution of the paving material onto the surface;

a drive assembly comprising at least one of wheels or a traction device, and a power source, for driving the paving machine along the surface for paving;

an operator control assembly mounted on a paving machine housing above the wheels or traction device of the drive assembly, the operator control assembly comprising:

one or more controls for operation of the paving assembly and drive assembly;

an operator seat mounted on a pivotable base that is attached at a pivot point to the paving machine housing; and a safety cage about the operator seat, the safety cage being attached to one or more of the operator seat and pivotable base, wherein the safety cage comprises:

(i) a frame extending behind the operator seat;

(ii) one or more upper body protecting bars extending from the frame along the side of the operator seat, and towards a front of the operator seat, and (iii) one or more head and neck protecting bars extending from the frame at or above an upper end of the operator seat, wherein the operator seat is pivotable in a horizontal direction during operation of the paving machine, to rotate the operator seat outwardly away from the paving machine housing, and wherein the safety cage rotates with the operator seat to protect the head and neck, and the upper body, of the operator during operation of the paving machine.

2. The paving machine according to claim 1, wherein the frame comprises two parallel bars that are directly or indirectly mounted to the pivotable base.

3. The paving machine according to claim 1, wherein the safety cage is absent of any overhead enclosure.

4. The paving machine according to claim 1, wherein the safety cage is attached by welding or bolting onto the operator seat or pivotable base.

5. The paving machine according to claim 1, wherein the one or more upper body protecting bars comprises a pair of two parallel bars extending from the frame, each pair extending along opposing sides of the operator seat.

6. The paving machine according to claim 5, wherein the two parallel bars of each pair extend along their respective opposing sides at an angle of from 0° to 90°, 15° to 75°, 30° to 50°, and/or at 45°, with respect to respective opposing sides of the operator seat.

7. The paving machine according to claim 5, wherein the two parallel bars of each pair are spaced apart from each other in the vertical direction, with a lower bar being located towards a lower end of the operator seat, and an upper bar being located towards an upper end of the operator seat.

8. The paving machine according to claim 5, wherein the two parallel bars of each pair are vertically spaced apart from each other by at least 10 inches, at least 12 inches, at least 15 inches, at least 18 inches, and/or at least 20 inches, and no more than 30 inches, no more than 25 inches, and/or no more than 22 inches.

9. The paving machine according to claim 5, wherein the two parallel bars of each pair extend from the frame along the respective opposing sides of the operator seat by a length of at least 4 inches, at least 6 inches, and/or at least 7 inches, and no more than 15 inches, no more than 12 inches and/or no more than 10 inches.

10. The paving machine according to claim 5, wherein for the two parallel bars of each pair, a ratio of the vertical distance between the two parallel bars, to a length the bars extend along respective opposing sides of the operator seat, is at least 1.5:1, at least 1.75:1, at least 2:1, at least 2.25:1 and/or at least 2.5:1, and less than 5:1, less than 4:1, less than 3:1 and/or less than 2.75:1.

11. The paving machine according to claim 5, wherein the two parallel bars of each pair are connected together by a connecting bar that is spaced away from the frame.

12. The paving machine according to claim 11, wherein the connecting bar has a length connecting the two parallel bars of each respective pair together of at least 10 inches, at least 12 inches, at least 15 inches, at least 18 inches, and/or at least 20 inches, and no more than 30 inches, no more than 25 inches, and/or no more than 22 inches.

13. The paving machine according to claim 11, wherein the connecting bar is a U-shaped bar.

14. The paving machine according to claim 13, wherein the frame comprises two parallel bars that extend vertically towards a top of the operator seat.

15. The paving machine according to claim 14, wherein for each pair of the two parallel bars extending along respective sides of the operator seat, the connecting bar connecting the two parallel bars, and at least a portion of the two parallel bars of the frame, together with the two parallel bars of each pair, form an impact blocking structure that protects the upper body of operator from impacts to the upper body during operation of the paving machine.

16. The paving machine according to claim 14, wherein a distance between the two parallel bars of the frame in the horizontal direction is at least 16 inches, at least 18 inches, at least 20 inches, and/or at least 22 inches, and no more than 30 inches, no more than 28 inches, and//or no more than 26 inches.

17. The paving machine according to claim 14, wherein the one or more head and neck protecting bars comprises a lower bar and an upper bar extending between the two parallel bars of the frame, and wherein the lower and upper bar are both located toward or above the top of the operator seat.

18. The paving machine according to claim 17, wherein the lower bar is located towards an upper end of the operator seat, but below the top of the operator seat, and the upper bar is located above the top of the operator seat.

19. The paving machine according to claim 17, wherein the upper bar is curved to connect to the two parallel bars of the frame.

20. The paving machine according to claim 17, wherein a height of the upper bar, as measured from an opposing end of the frame, is at least 26 inches, at least 28 inches, and/or at least 30 inches, and no more than 40 inches, 38 inches, 36 inches and/or 35 inches.

21. The paving machine according to claim 17, wherein a height of the lower bar, as measured from an opposing end of the frame, is at least 20 inches, at least 22 inches and/or at least 24 inches, and less than 30 inches, less than 28 inches, and/or less than 26 inches.

22. The paving machine according to claim 17, wherein a vertical distance between the upper and lower bars is at least 6 inches, at least 8 inches and/or at least 10 inches, and less than 18 inches, less than 16 inches and/or less than 14 inches.

23. The paving machine according to claim 17, wherein length of each of the upper and lower bars in the horizontal direction extending between the parallel bars of the frame is at least 16 inches, at least 18 inches, at least 20 inches, and/or at least 22 inches, and no more than 30 inches, no more than 28 inches, and//or no more than 26 inches.

24. The paving machine according to claim 17, wherein a ratio of a length in the horizontal direction of the upper and lower bars, to the vertical distance between the upper and lower bars, is at least 1.5:1, at least 1.75:1, at least 2:1, at least 2.25:1 at least 2.5:1, and/or at least 2.75:1, and less than 5:1, less than 4:1, less than 3:1 and/or less than 2.9:1.

25. The paving machine according to claim 17, wherein the upper and lower bars, and portions of the parallel bars of the frame that connect the upper and lower bars, form an impact blocking structure that protects the head and neck of the operator from impacts to the head and neck during operation of the paving machine.

26. The paving machine according to claim 17, wherein the paving machine comprises at least two of the operation control assemblies, with each of the operation control assemblies comprises respective safety cages.

27. A method of paving a surface, comprising operating the paving machine according to claim 1 to spread paving material on the surface.

* * * * *